United States Patent [19]

Morton

[11] 4,256,993

[45] Mar. 17, 1981

[54] ENERGY SAVING DEVICE FOR RAPID-START FLUORESCENT LAMP SYSTEM

[75] Inventor: Edward W. Morton, Teaneck, N.J.

[73] Assignee: Westinghouse Electric Corp., Pittsburgh, Pa.

[21] Appl. No.: 45,451

[22] Filed: Jun. 4, 1979

[51] Int. Cl.[3] ..... H05B 41/16

[52] U.S. Cl. ..... 315/106; 315/228; 315/240; 315/360

[58] Field of Search ..... 315/106, 227 R, 228, 315/240, 307, 324, DIG. 4, 360, 362

[56] References Cited

U.S. PATENT DOCUMENTS

| | | | |
|---|---|---|---|
| 2,796,554 | 6/1957 | Strecker | 315/97 |
| 3,098,953 | 7/1963 | Herr | 361/197 |
| 3,320,440 | 5/1967 | Reed | 307/247 R |
| 3,911,320 | 10/1975 | Crawford et al. | 315/240 |
| 3,931,544 | 1/1976 | Pitel | 315/240 X |
| 3,954,316 | 5/1976 | Luchetta | 315/96 |
| 4,082,981 | 4/1978 | Morton et al. | 315/106 X |
| 4,146,820 | 3/1979 | Bessone et al. | 315/227 R |

*Primary Examiner*—Eugene R. LaRoche
*Attorney, Agent, or Firm*—W. D. Palmer

[57] ABSTRACT

Add-on device for connection in series with one lamp of a two-lamp rapid-start fluorescent light system to reduce by a predetermined amount the nominal power consumption and light output of the system. The device has normally closed relay contacts which are in circuit with one of the electrodes of one of the lamps and a power-reducing capacitor is in shunt with one of the relay contacts. Upon turning on the system, a solid-state time-delay and relay-coil-energizing circuit is actuated which opens the relay contacts only after the lamps have been started and are operating with nominal power consumption. This places the shunt capacitor in series with the operating lamps and reduces the nominal power consumption by a predetermined amount.

4 Claims, 4 Drawing Figures

ENERGY SAVING DEVICE FOR RAPID-START FLUORESCENT LAMP SYSTEM

BACKGROUND OF THE INVENTION

This invention relates to energy saving devices for fluorescent light systems and, more particularly, to an add-on device for connection in series with one lamp of a two-lamp rapid-start-type fluorescent light system to reduce by a predetermined amount the nominal electrical consumption of the system.

The majority of fluorescent lighting systems are of the so-called two-lamp rapid-start type in which the lamp electrodes are preheated for a very short time by a relatively low heater voltage, with the full open-circuit voltage thereafter applied to one of the lamps, causing it to start. An impedance parallels the second lamp and the voltage drop thereacross then causes the second lamp to start. Thereafter, the two lamps operate in series. This lighting system gives excellent performance and excellent lamp life.

In recent years, there has been considerable emphasis on reducing electrical energy consumption in existing fluorescent lamp systems and one such system is disclosed in U.S. Pat. No. 3,954,316, dated May 4, 1976 to Luchetta. In this system, an isolation transformer is connected in circuit with one of the heater windings for a lamp electrode and a power-reducing capacitor is connected between the primary and secondary of the isolation transformer. When the lamps are operating, the additional capacitor in circuit reduces the power consumed by the system by a predetermined amount. The use of capacitors in series with a rapid start type system to vary the power consumption thereof is also shown in U.S. Pat. No. 3,911,320, dated Oct. 7, 1975 to Crawford.

In U.S. Pat. No. 4,082,981, dated Apr. 4, 1978 to E. W. Morton, the present applicant, and J. F. Gilmore is disclosed an add-on type energy saving device for a fluorescent lamp system wherein two positive temperature coefficient of resistance (PTC) resistors complete the circuit to one of the lamp electrodes and a power reducing capacitor is connected in shunt with one of the PTC members. When the system is energized, heater current is passed through the lamp electrodes, which causes the PTC members to heat and rapidly rise in resistance. This places the shunting capacitor in series with the operating lamps, thereby reducing the power of the system.

Electronic time delay circuits which introduce a predetermined time delay for actuation of a relay coil are known and a typical circuit is described in U.S. Pat. No. 3,098,953, dated Aug. 1, 1960 to Herr. Another type of such circuit arrangement which utilizes a unijunction transistor is shown in U.S. Pat. No. 3,320,440, dated May 16, 1967 to Reed.

A rectifier and voltage doubler circuit as used in conjunction with an energizing circuit for a discharge lamp is disclosed in U.S. Pat. No. 3,931,544, dated Jan. 6, 1976 to Pitel.

The basic two-lamp rapid-start fluorescent light system is disclosed in U.S. Pat. No. 2,796,554, dated June 18, 1957 to Strecker.

SUMMARY OF THE INVENTION

The present invention relates to an add-on device for connection in series with one lamp of a two-lamp rapid-start-type fluorescent light system to reduce by a predetermined amount the nominal electrical consumption and light output of the operating lamps. The basic system is conventional and each of the lamps comprise a tubular body terminating in double contacts at each end thereof, with each of the double contacts electrically connecting to the ends of electrodes which are operatively disposed within the envelopes proximate the ends thereof. The basic system comprises a ballast transformer means having input terminals and output terminals with the input terminals adapted to be connected to a source of electrical energy. There are provided two pairs of socket means which are adapted to receive and retain the two rapid-start fluorescent lamps in series-circuit arrangement, with a starting capacitor connected in parallel with one of the lamps as connected in series circuit. A ballast capacitor connects in series with one of the transformer secondary output terminals and the output of the series-connected ballast capacitor and ballast transformer connect to those sockets which are adapted to receive the remote or end-member double contacts of the lamps as connected in series circuit, in order to apply the secondary output voltage of the ballast transformer and ballast capacitor across the series-connected lamps. To complete the circuit, lamp electrode heaters which comprise small secondary transformer windings are associated with the ballast transformer and connect to the lamp-receiving sockets, in order to apply across each of the electrodes of the lamps as connected in the system a relatively small electrode heater potential.

In accordance with the present invention, the add-on device comprises a casing having a pair of input contacts which are adapted to be connected with one of the sockets of the system and a pair of output terminals for connection to the double contacts at one end of one of the lamps. The input contacts of the add-on device directly electrically connect to the output terminals of the add-on device through a pair of normally closed coil-operated relay contacts, and one of the relay contacts has connected in parallel therewith a power-reducing capacitor which, when in circuit with the lamps, will reduce by a predetermined amount the power consumed by the operating system. A solid-state time-delay and relay-coil energizing circuit connects across the input contacts of the add-on device. The time-delay action of this circuit is initiated by application of electrode heater potential across the input contacts of the add-on device when the system is initially energized, in order to pass heater current through the lamp electrode which connects thereto. After the lamps in the system are operating with nominal wattage input and a short predetermined time has elapsed, the circuit operates to energize the relay coil which opens the pair of normally closed relay contacts and places the power-reducing capacitor in series circuit with the operating lamps. The relay coil thereafter remains energized to maintain the relay contacts open until the entire system is again deenergized.

BRIEF DESCRIPTION OF THE DRAWINGS

For a better understanding of the invention, reference may be had to the preferred embodiments, exemplary of the invention, shown in the accompanying drawings, in which.

DESCRIPTION OF THE PREFERRED EMBODIMENTS

Figure 1:
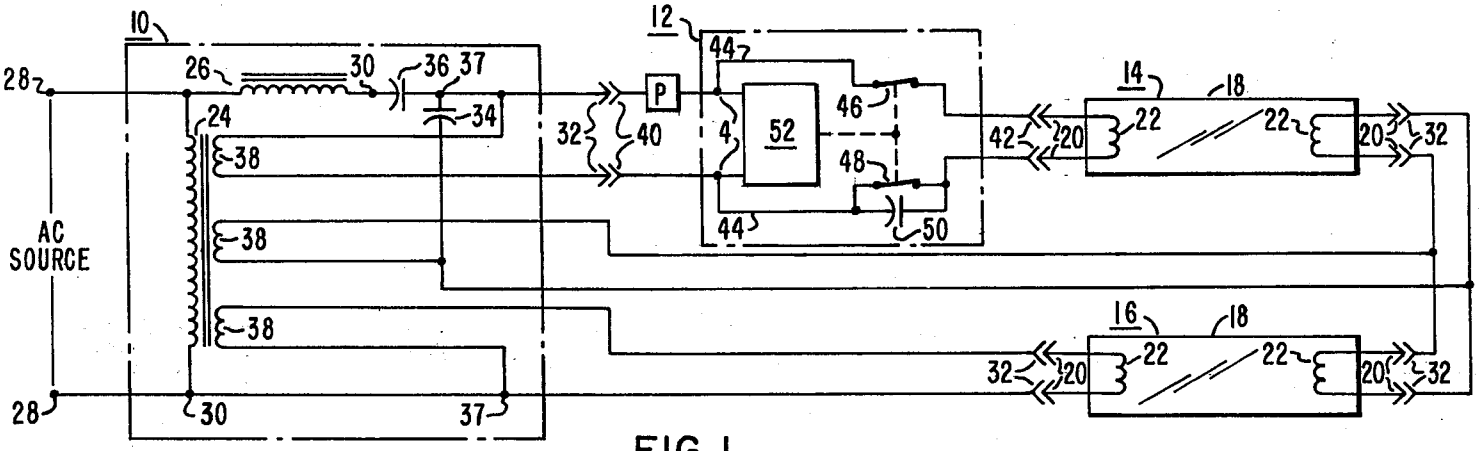
FIG. 1 is a schematic view of a standard two-lamp rapid-start system with the present add-on device shown incorporated therein in block-diagram form.

The basic two-lamp rapid-start-type fluorescent light system 10 as shown in FIG. 1 is generally as described in the aforementioned U.S. Pat. No. 2,796,544, dated June 18, 1957 to Strecker with the present add-on device 12 shown in block form and incorporated therein. This add-on device is adapted to be connected in series with one lamp of the two-lamp system in order to reduce by a predetermined amount the nominal electrical consumption and light output of the operating lamps. Each of the lamps 14 and 16 comprise a tubular body 18 terminating in double contacts 20 at each end thereof, with each of the double contacts 20 electrically connecting to the ends of electrodes 22 operatively disposed within the envelopes 18 proximate the ends thereof.

The basic system comprises ballast transformer means having a primary 24 and a secondary 26. Connecting across the primary are input terminals 28 which are adapted to be connected to a source of electrical energy and the ballast transformer means has output terminals 30 across which the secondary output voltage of the ballast transformer is developed.

Two pairs of socket means 32, shown in diagrammatic form, are adapted to receive and retain the two rapid-start fluorescent lamps 14 and 16 in series-circuit arrangement, and a starting capacitor 34 connects in parallel with one of the lamps, in this case, the lamp 14.

One of the output terminals of the ballast transformer connects in series with a ballast capacitor 36 and the outputs 37 of the series-connected ballast transformer and ballast capacitor 36 connect to those sockets 32 which are adapted to receive the remote double contacts 20 of the lamps as connected is series circuit in order to apply the secondary output voltage of the ballast transformer and capacitor 36 across the series-connected lamps.

A lamp electrode heater means comprising three small secondary windings 38 connect to the individual sockets 32, in order to apply across each of the electrodes 22 of the lamps 14 and 16 a relatively small heater potential. In the normal operation of such a rapid-start circuit, after the electrodes are preheated to partially ionize the gas within the lamps and increase the electron emissivity of the electrodes, the lamps start sequentially and then operate in series with the ballast transformer and the ballast capacitor 36. Such a circuit operates somewhat off resonance and an increase in capacitance detunes the circuit further, thereby reducing the power consumed by the system.

Figure 3:
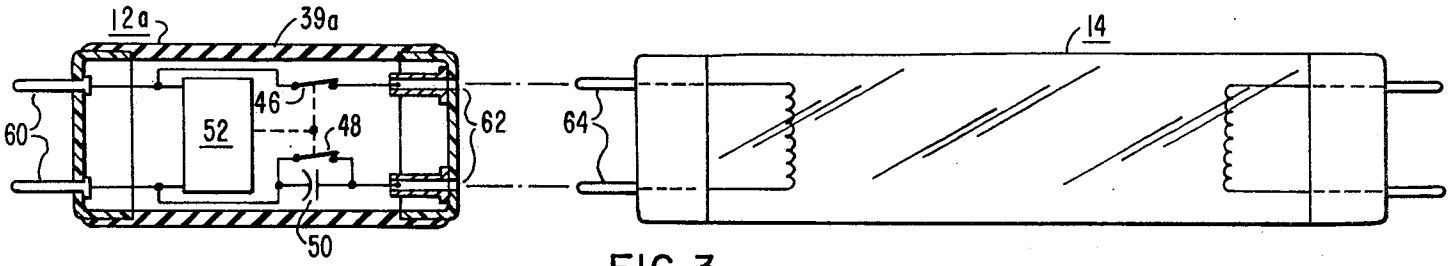
FIG. 3 is an elevational view, shown partly in section, of a fluorescent lamp and associated add-on device which is adapted to be separated from the lamp with which it is operatively associated.
Figure 4:
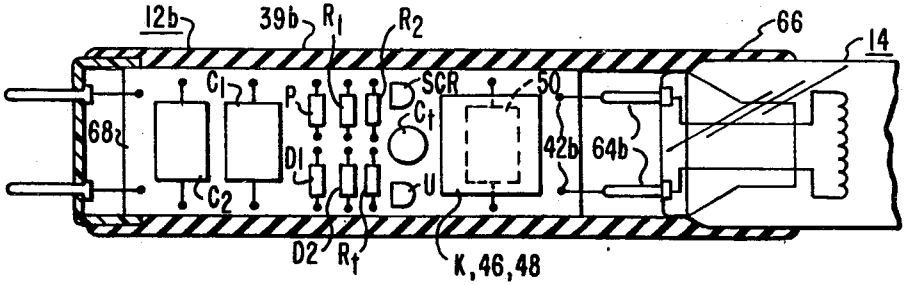
FIG. 4 is an elevational view, partly in section, of an add-on device which is permanently connected to the lamp with which it is operatively associated.

In accordance with the present invention, the add-on device 12 comprises a casing means 39, shown in detail in FIGS. 3 and 4 as a tubular phenolic member **39*a* or 39*b* having a pair of input contacts 40 adapted to be connected with one of the sockets 32 of the system and there are also provided a pair of output terminals 42 for connection to the double contacts 20 of one of the lamps 14. The input contacts 40 of the add-on device are directly connected through conducting leads 44 to the output terminals 42 of the add-on device through a pair of normally closed coil-operated relay contacts 46, 48 and the relay contact 48 has connected in parallel therewith a power reducing capacitor 50** of predetermined value which, when in circuit with the operating lamps, will reduce by a predetermined amount the power consumed by the series-connected lamps as operated.

A solid-state time-delay and relay-coil-energizing circuit 52, shown in block form in FIG. 1, connects across the input contacts 40 of the add-on device and the time-delay action of the circuit 52 is initiated by the application of heater potential across the input contacts 40, when the system is initially energized. This passes heater current through the conductors 44 and closed relay contacts 46 and 48 and operation of the rapid-start system is initiated to cause the lamps to operate with nominal wattage input, a typical example being 40 watts input for each lamp. After a short predetermined time has elapsed, such as 10 seconds, the circuit 52 operates to energize the relay coil to open both relay contacts 46 and 48 placing the power reducing capacitor 50 in series circuit with the operating lamps 14 and 16. For the detailed circuit as described hereinafter, the power consumption for each lamp is reduced from 40 W to 25 W. The circuit 52 operates to maintain the relay contacts 46 and 48 in an open condition until the rapid-start system is again deenergized by turning same off.

Figure 2:
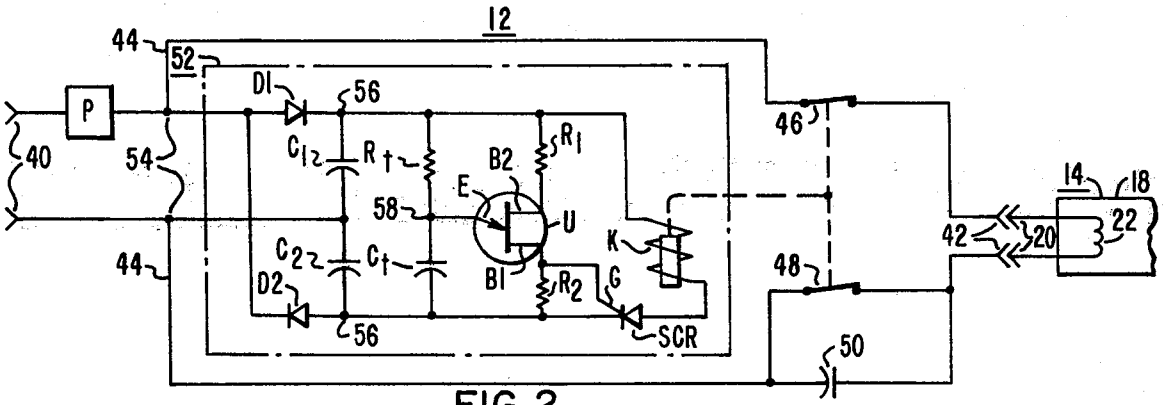
FIG. 2 is a circuit diagram of the present solid-state add-on device.

A circuit diagram for the add-on device 12 is shown in FIG. 2 wherein the input terminals 40 and output terminals 42 are shown in diagrammatic form with the paralleling conductors 44, closed relay contacts 46 and 48 and power reducing capacitor 50 also shown. The energizing circuit 52 comprises a diode-capacitor rectifier and voltage-double-type circuit comprising two diodes D1 and D2 and capacitors C1 and C2 having an input 54 connecting to the input contacts 40 of the add-on device. The diode-capacitor rectifier and voltage-doubler circuit has an output at terminals 56 across which is developed a DC voltage which is enhanced as compared to the relatively small heater voltage available across the input terminals 40 of the add-on device. This enhanced DC voltage is needed to operate the relay coil in a satisfactory manner, as will be explained hereinafter.

A series connected resistor $R_t$ and capacitor $C_t$, which form an RC timing circuit, are connected across the output 56 of the voltage-doubler circuit. A unijunction transistor U having a first base B1 and a second base B2 and an emitter E connects in series with biasing resistors R1 and R2, with the series-connected unijunction transistor bases B1 and B2 and biasing resistors R1 and R2 also connected across the output 56 of the rectifier and voltage doubler circuit. The emitter of the unijunction transistor connects to the midpoint 58 of the RC series circuit.

A gate controlled semiconductor switching means (SCR) having an anode and a cathode is connected in series with an energizing coil K for the relay contacts 46 and 48 and the series-connected SCR and the relay energizing coil K also connect across the output 56 of the voltage doubler circuit, with the gate G of the SCR connecting to the first base B1 of the unijunction transistor U.

In operation of the circuit, the relatively small heater potential is amplified by the diode-capacitor rectifier and voltage doubler circuit to provide an amplified voltage at the output terminals 56. This charges the RC circuit and when the voltage developed at the midpoint 58 of the RC circuit reaches a predetermined value, such as 5.3 volts, after a predetermined period of time such as ten seconds has elapsed, the unijunction transistor U is triggered with the charge on capacitor $C_t$ serving to gate the SCR to actuate the relay coil K and open the relay contacts 46 and 48. This in turn places the power-reducing capacitor 50 in series with the operating lamps and the flow of current through the relay coil K continues to maintain the relay contacts 46 and 48 open until the circuit is again deenergized by turning off the system. A suitable circuit protective device P is included in series with one of the input terminals 40.

Following is a detailed description of specific components which are suitable for use in the circuit as shown in FIG. 2.

| Item | Components Listing<br>Description |
|---|---|
| SCR | Motorola, MCR101 (or equivalent) |
| U | Motorola, MU10 (or equivalent) |
| K | Sigma 60RE2S-5DC DPDT (or equivalent)<br>Arrow-M NF2 5V (or equivalent) |
| $C_1$,$C_2$ | 1000 μF 6V DC Volts |
| Ct | 47 μF 6.3 DC Volts Diam. Max. .236"<br>Length Max. .433" |
| $D_1$,$D_2$ | 1N4001 (or equivalent) |
| R1 | 330 ohms ¼ W |
| R2 | 47 ohms ¼ W |
| Rt | 100K ohms ¼ W |
| 50 | 5 μF ± 10%, 160 Vac. (min.) Metallized Polyester Film. Seacor #105 (or equiv.); or Electrocube 230B1C505K (or equiv.). |
| P | Fuse, Thermal Protector, or Fusible Link |

In actual performance, the average time period required for the system to shift to a reduced power condition, after the system is energized, is about 10 seconds although this can be varied by varying the values of the RC circuit components. Since the time-delay and relay-coil-energizing circuit is connected in parallel with one of the lamp electrodes, some of the power which would be used for electrode heating is dissipated in this circuit. Under varying test conditions, however, the steady-state voltage developed across the shunted electrode coil is only decreased by an average of about 2% from what the voltage would be if the parallelling time delay circuit were not used.

In FIG. 3 is shown one practical embodiment wherein the add-on device 12*a* is adapted to be connected separately to one of the sockets and the lamp is separable from the add-on device so that the device and lamp can be individually replaced. In such an embodiment, a special shortened lamp is used, or it is necessary to adjust the spacing of the socket portions of the system. More particularly, the casing 39*a* for the add-on device 12*a* as shown in FIG. 3 is double ended and separable from the lamp to which the output terminals of the add-on device are to be connected. This casing 39*a* has a tubular configuration and is formed of suitable material such as phenolic resin. The input terminals of this add-on device 12*a* are formed as pins 60 which are adapted to be inserted into one of the sockets 32 of the rapid-start system. The output terminals of the add-on device are formed as pin-receiving sockets 62 which are adapted to have inserted therein the twin base pins 64 of the lamp to which it is to be connected.

In the embodiment 12*b* of the add-on device as shown in FIG. 4, the device is permanently connected with one of the shortened lamps. In such an embodiment, the casing member 39*b* has an enlarged extension thereof 66 which snugly fits over an end of the lamp and the output terminals 42*b* of the add-on device are permanently connected to the lamp double contacts 64*b*, which are proximate the add-on device.

Also shown in FIG. 4 is a circuit board 68 on which the elements comprising the add-on device are mounted with the preferred positioning of the circuit elements on this circuit board being shown.

I claim:

1. An add-on device for connection in series with one lamp of a two-lamp rapid-start-type fluorescent light system to reduce by a predetermined amount the nominal electrical consumption and light output of the operating lamps, said lamps each comprising a tubular body terminating in double contacts at each end thereof with each of the double contacts electrically connecting to the ends of electrodes operatively disposed within said envelopes proximate the ends thereof, said rapid-start system comprising:

ballast transformer means having input terminals and output terminals, and said input terminals adapted to be connected to a source of electrical energy;

two pairs of socket means adapted to receive and retain the two rapid-start fluorescent lamps in series-circuit arrangement, and a starting capacitor means connecting in parallel with one of the lamps as connected in series circuit;

the output terminals of said ballast transformer means connecting through ballast capacitor means to those socket means which are adapted to receive the remote double contacts of said lamps as connected in series circuit in order to apply the secondary output voltage of said ballast transformer means and said ballast capacitor means across said series-connected lamps; and, lamp electrode heater means comprising secondary transformer winding means associated with said ballast transformer means and connecting to said socket means to apply across each of the electrodes of said lamps as connected in said system a relatively small electrode heater voltage, said add-on device comprising:

(a) casing means having a pair of input contacts adapted to be connected with one of said socket means of said system, and a pair of output terminals for connection to the double contacts at one end of one of said lamps;

(b) said input contacts of said add-on device directly electrically connected to said output terminals of said add-on device through a pair of normally closed coil-operated relay contacts, and one of said relay contacts having connected in parallel therewith power-reducing capacitor means of predetermined value which, when in circuit with said lamps, will reduce by a predetermined amount the power consumed by said series-connected lamps as operated;

(c) a solid-state time-delay and relay-coil-energizing circuit connecting across said input contacts of said add-on device, the time-delay action of said circuit being initiated by the application of heater voltage across said input contacts of said add-on device when said system is initially energized to pass heater current through the lamp electrode connected thereto, and after said lamps in said system are operating with nominal wattage input and a short predetermined time has elapsed, said circuit operating to energize said relay coil and open said pair of normally closed relay contacts to place said power-reducing capacitor means in series circuit with said operating lamps, and said relay-coil-energizing circuit thereafter continuing to energize said relay coil to maintain said relay contacts open until said system is deenergized.

2. The add-on device as specified in claim 1, wherein said rapid-start type lamps to be operated each comprise a tubular body terminating in twin contact pins projecting from each end thereof with each of the twin pins electrically connecting to the ends of said electrodes, said casing of said add-on device is double-ended and separable from the said lamp to which the output terminals of said add-on device are to be connected, said input terminals of said add-on device are formed as base pins which are adapted to be inserted into one of said socket means of said system, and said output terminals of said add-on device are formed as pin-receiving sockets adapted to have inserted therein twin pins of the lamp to which it is to be connected.

3. The add-on device as specified in claim 1, wherein said casing of said add-on device is made integral with one of said fluorescent lamps and projects from an end of the tubular portion thereof, and the output terminals for said add-on device are permanently connected to those lamp double contacts which are proximate said add-on device.

4. The add-on device as specified in claims 1, 2 or 3, wherein said solid-state time-delay and relay-coil-energizing circuit comprises:

(a) a diode-capacitor rectifier and voltage-doubler-type circuit having an input connected across said input contacts of said add-on device and an output across which is developed a voltage which is enhanced as compared to the relatively small heater voltage available across said input contacts of said add-on device;

(b) a series connected resistor and capacitor which form an RC timing circuit connected across the output of said rectifier and voltage-doubler-type circuit, a unijunction transistor having a first base and a second base and an emitter, said bases of said unijunction transistor connecting in series with biasing resistors of predetermined value, said series-connected unijunction transistor bases and biasing resistors connected across the output of said rectifier and voltage-doubler-type circuit, and the emitter of said unijunction transistor connected to the midpoint of said RC circuit; and (c) a gate-controlled semiconductor switching means having an anode and a cathode connected in series with the energizing coil for said relay means, said series-connected switching means and said relay energizing coil connected across the output of said rectifier and voltage-doubler-type circuit, and the gate of said switching means connecting to the first base of said unijunction transistor, whereby upon energization of said system, the applied heater voltage is amplified by said rectifier and voltage-doubler-type circuit and charges said RC circuit, and when the voltage developed at the mid-point of said RC circuit reaches a predetermined value after a predetermined time period, said unijunction transistor is triggered to gate said switching means and energize said relay coil to open said relay contacts, with said relay coil remaining energized until said system is deenergized.

* * * * *